US006804511B1

(12) United States Patent
Kakinuma

(10) Patent No.: US 6,804,511 B1
(45) Date of Patent: Oct. 12, 2004

(54) RADIO CONTROLLING APPARATUS

(75) Inventor: Hideaki Kakinuma, Tokyo (JP)

(73) Assignee: Vertex Standard Co., Ltd. (JP)

( * ) Notice: Subject to any disclaimer, the term of this patent is extended or adjusted under 35 U.S.C. 154(b) by 0 days.

(21) Appl. No.: 09/470,162

(22) Filed: Dec. 22, 1999

(30) Foreign Application Priority Data

Dec. 22, 1998 (JP) ..... 10-376180

(51) Int. Cl.[7] ..... H04M 3/00
(52) U.S. Cl. ..... 455/420; 455/450; 455/296
(58) Field of Search ..... 455/418–420, 455/501–506, 63–67.3, 255–260, 296, 450; 340/3.6–3.63, 825.69

(56) References Cited

U.S. PATENT DOCUMENTS 4,661,996 A * 4/1987 Scandurra ..... 455/205
5,764,697 A * 6/1998 Sakuma et al. ..... 375/239
5,982,742 A * 11/1999 Leung et al. ..... 370/213
6,005,508 A * 12/1999 Tsui ..... 341/173
6,226,515 B1 * 5/2001 Pauli et al. ..... 455/426
6,308,062 B1 * 10/2001 Chien et al. ..... 455/420

* cited by examiner

*Primary Examiner*—Charles Craver
(74) *Attorney, Agent, or Firm*—Fulwider Patton Lee & Utecht, LLP

(57) ABSTRACT

The present invention provides a radio controlling apparatus that performs a change to a vacant channel rapidly to allow smooth control even if an uncontrollable state due to radio interference suddenly occurs. In a radio controlling transmission apparatus of the radio controlling apparatus, a reception section for searching a vacant channel is provided. When a vacant channel is detected, it is stored in memory of the radio controlling transmission apparatus. A transmission section transmits control signals, a selection code, and vacant channel data, the control signals being output by an operation section using a control signal transmission timer and a selection code transmission timer. Using a reception section, a controlled apparatus of the radio controlling apparatus receives signals. If the vacant channel data and the selection code are received, the controlled apparatus stores them in memory of the controlled apparatus. If control signals are also received, the control signals are sent to a controlled section via a decoder. However, if the selection code is not received by the controlled apparatus for the duration of a selection code holding timer, control abnormality is determined to have occurred. A visible abnormal operation is performed and a reception channel of the controlled apparatus is changed to the vacant channel stored in the memory of the controlled apparatus. In the radio controlling transmission apparatus, a change to the vacant channel is performed and the selection code is transmitted. When the selection code is detected by the controlled apparatus, control of the controlled apparatus is performed using the vacant channel thereafter.

17 Claims, 6 Drawing Sheets

(a)

(b)

RADIO CONTROLLING APPARATUS

BACKGROUND OF THE INVENTION

1. Field of the Invention

The present invention relates to the setting of transmission/reception frequencies in a radio control apparatus for remotely controlling devices such as model airplanes, automobiles, boats, etc.

2. Description of the Related Art

To carry out transmission in a conventional radio controlling apparatus, a high frequency circuit for determining a transmission frequency band and a type of carrier wave is utilized. Pulse Position Modulation (PPM) or Pulse Code Modulation (PCM) signal systems are used in conjunction with amplitude or frequency modulation of the carrier wave.

Regarding such frequencies for a radio controlling apparatus, usable frequency bands and frequencies in the frequency bands are controlled under the Radio Law of each country. In Japan, for example, in the frequency band of 27 MHz, the range of frequencies from 26.995 MHz to 27.245 MHz is divided into six bands, at intervals of 50 KHz. However, 27.245 MHz and 27.255 MHz are used as a common band. In the frequency band of 40 MHz, the range of frequencies from 40.61 MHz to 40.85 MHz is divided into thirteen bands, at intervals of 20 KHz. In the United States, in the frequency band of 72 MHz, the frequency range of 72.01 MHz to 72.99 MHz is divided into fifty bands, at intervals of 20 KHz. In Germany, the frequency of the radio controlling apparatus for a model is defined under its Radio Law.

In particular, self-imposed control on the frequency band of 40 MHz is provided under the Recommendation Standard and Adaptation Certified and Recognized Standard (Notification No. 895 of the Ministry of Posts and Telecommunications, Nov. 24, 1984) in Japan. This self-imposed control is required to be satisfied. Because the self-imposed control defines that "an oscillation system should be a crystal oscillation system," a Phase-Locked Loop (PLL) circuit cannot be used in the frequency band of 40 MHz. Although nine more channels are allowed to be used in the band of 72 MHz, each channel is changed on the basis of a crystal exchanging system, wherein a high frequency circuit-designed in modules and with frequencies assigned to each country—is utilized in a radio controlling apparatus. In general, the frequency of a carrier wave is changed by exchanging crystal oscillators. On the other hand, many countries allow the use of PLL circuits, but the use differs depending on the Radio Law of each country. When a PLL circuit is used, the changing and setting of the frequency can be easily accomplished in a radio communication apparatus.

FIG. 8 is a block diagram showing an example of a conventional radio controlling transmission apparatus. Voltage values, which are obtained by the operation of elements 2A, 2B, 2C and 2D, are brought to input terminals of a multiplexer, respectively. From the output of the multiplexer, the voltage values pass through an A/D converter, and parallel output signals from the A/D converter are applied to a parallel-serial converter. Addresses of the operational elements 2A, 2B, 2C and 2D are read sequentially and converted to serial data, so that a carrier wave is FSK modulated and transmitted.

An example of the serial signal will be explained with reference to time charts shown in FIG. 7. This figure shows a signal sequence obtained by the operation of eight operational elements, wherein one frame is set at 22.5 msec. An one shot pulse width T2 of a rise portion according to the control of each signal is a variable value of 450 $\mu$sec to 950 $\mu$sec, and a channel pulse period T4 is 1520 $\mu$sec. Although each one shot pulse varies depending on the amount of control; the bands of reset pulse widths T3 and T3' are set to at least 5 msec at the minimum. Since control data is updated every one frame, or 22.5 msec, smooth control can be performed.

Since radio control is frequently performed with a small number of channels at a specific location, there is the problem of radio interference, which causes an uncontrollable state in the devices to be controlled. Various designs are disclosed in the prior art to avoid such radio interference. For example, unexamined Japanese Patent Publication No. Hei 34891 discloses a band detector for detecting whether or not a channel, which is to be controlled by a radio controlling apparatus at a control start time, is used by another apparatus. The band detector makes its detection before the control is performed. If a desired control channel is in use, the band detector outputs an alarm signal and turns on a red light-emitting diode to inform that the channel is in use. If the desired control is in a vacant channel, the band detector turns on a green light-emitting diode to inform that the channel is not in use. This allows the channel to be changed smoothly.

However, working frequencies are limited in radio controlling apparatus. Six bands are assigned to the frequency band of 27 MHz, thirteen bands are assigned to the frequency band of 40 MHz, and nine bands are assigned to the band of 70 MHz. Model airplanes and helicopters using a radio controlling apparatus can only be operated at limited locations. In addition, at such a location, there is the danger that they may crush or plunge into a crowd due to the occurrence of an uncontrollable state. A case in which an uncontrollable state occurs because of radio interference with the radio controlling apparatus increases with beginners who are not familiar with the control of the apparatus. An object of the present invention is to provide a radio controlling apparatus, which changes a channel being interfered to a vacant channel rapidly and allows smooth control even if an uncontrollable state suddenly occurs.

SUMMARY OF THE INVENTION

According to the present invention, there is provided a radio controlling apparatus which includes an operation section including a joy stick; a control section having a central processing unit (CPU) and memory; a radio controlling transmission apparatus having a transmission section for transmitting control signals based on an operation of the operation section; and a controlled apparatus, which is controlled by receiving the transmitted control signals and converts the received signals to parallel signals that control controlled portions. When an uncontrollable state of a transmission channel occurs in the radio controlling transmission apparatus due to radio interference, the radio controlling apparatus utilizes a reception section for searching a vacant channel, which is used to change a channel being used to the vacant channel.

The radio controlling transmission apparatus includes a mechanism for setting a selection code transmission timer for assigning a control signal transmission time, a selection code transmission time and a reception section reception time, so as to transmit a selection code that distinguishes the control signals of the controlled apparatus from control signals of another apparatus at the selection code transmission time.

Further, the reception section for searching a vacant channel of the radio controlling transmission apparatus includes a vacant channel searching mechanism for searching a vacant channel during the duration of the reception time and for changing the channel and searching for another channel at the next reception time if there is no vacant channel, and a vacant channel transmitting mechanism for transmitting channel data at the next reception time when the vacant channel of the memory is rewritten. The vacant channel is stored in the memory of the control section.

The controlled apparatus includes a section for detecting a selection code from received signals, memory for storing the detected selection code, and a squelch mechanism for setting a selection code holding timer, which determines a detection interval of the selection code, and for holding a squelch state so as to output control signals for the duration of the selection code holding timer in which the selection code is held.

The controlled apparatus includes a vacant channel holding mechanism for storing or rewriting channel data of the memory storing vacant channels when there is a vacant channel data in the received signals. When the selection code holding time is over during the reception of the control signals and a squelch capability stops, the reception channel is automatically changed to a vacant channel stored in the channel data of the memory and an abnormal operation by which control abnormality is visibly recognized is executed. If there is the selection code in the signals received by the reception section, a squelch capability is exerted so that a controlled state is set.

When the radio controlling transmission apparatus detects control abnormality of the controlled apparatus during the control of the controlled apparatus performed by the operation of the control section, a channel change switch is operated to perform a change to a vacant channel stored in the memory, and an identification code is transmitted to restart control of the controlled apparatus.

Moreover, to prevent radio interference, a continuous tone controlled squelch system (CTCSS) or digital code squelch (DCS) system is used as the selection code to control the controlled section of the radio controlling apparatus by a squelch signal.

DETAILED DESCRIPTION OF THE PREFERRED EMBODIMENTS

Figure 1:
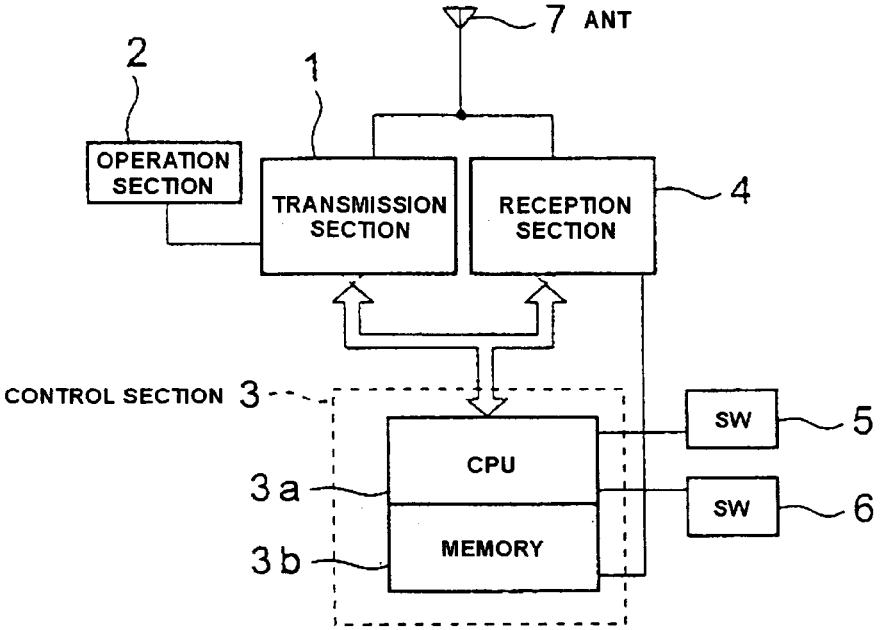
FIG. 1 is a block diagram showing a configuration of a radio controlling transmission apparatus according to an embodiment of the present invention, FIG. 1(*a*) is a block diagram of a radio controlling transmission apparatus, and FIG. 1(*b*) is a block diagram of a controlled apparatus controlled by the radio controlling transmission apparatus.
Figure 1:
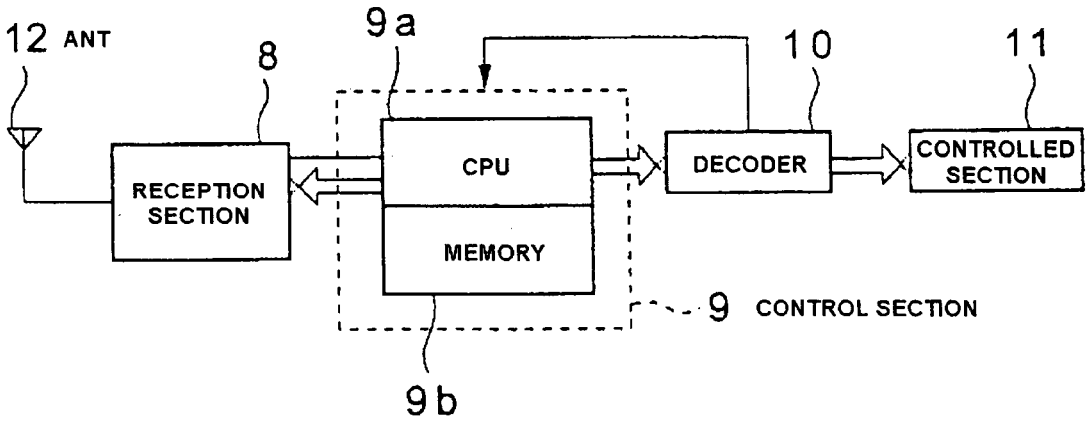
Figure 4:
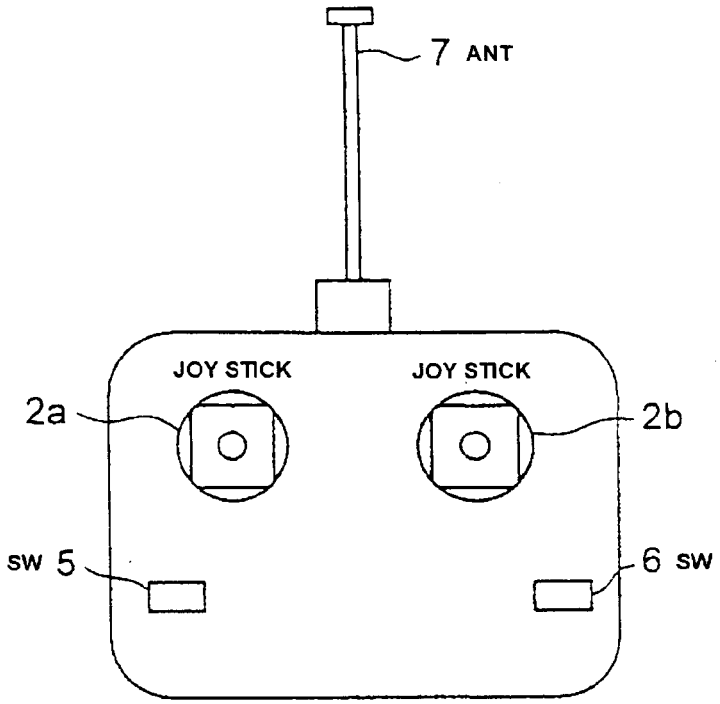
FIG. 4 is an outline view showing an example of the radio controlling transmission apparatus.

FIG. 1 consists of block diagrams showing a configuration of a radio controlling apparatus according to an embodiment of the present invention. FIG. 1(*a*) is a block diagram of a radio controlling transmission apparatus. FIG. 1(*b*) is a block diagram of a controlled apparatus. An example of the radio controlling transmission apparatus is illustrated in FIG. 4. First, the radio controlling transmission apparatus will be explained. Referring to FIG. 1(*a*), the radio controlling transmission apparatus comprises a transmission section 1, an operation section containing switch(es) and/or joystick(s), a control section 3 having a CPU 3*a* and memory 3*b*, a reception section 4, a power switch 5, a channel change switch 6, and an antenna 7.

Figure 7:
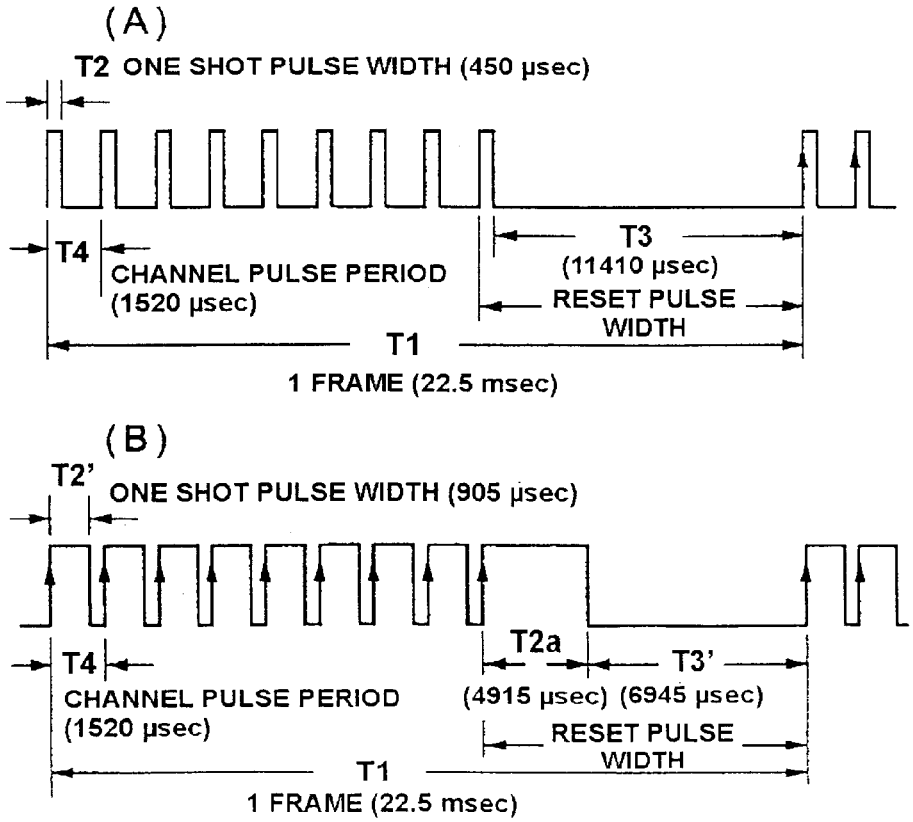
FIG. 7(*a*) and FIG. 7(*b*) are time charts for explaining a case in which FSK modulation is carried out using PPM signal.
Figure 8:
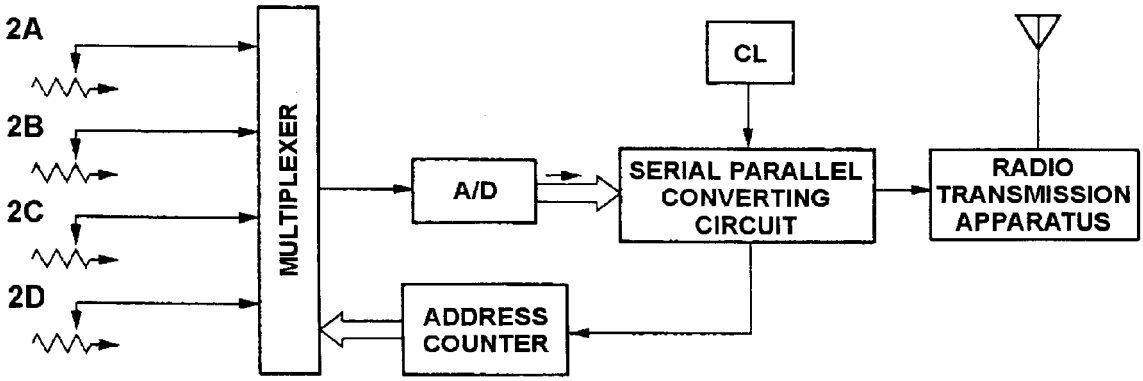
FIG. 8 is a block diagram showing a schematic configuration of a conventional radio controlling transmission apparatus.

To operate the radio controlling apparatus shown in FIG. 1, power switch 5 is turned on and the transmission frequency of the controlled apparatus is set to be the same frequency as that of the radio controlling transmission apparatus. Control signals and signals sent from the switch (es) and/or joy stick(s) of the operation section 2 are then inputted to the transmission section 1 for transmitting these signals. Next, a carrier wave of a radio controlling channel, e.g., in the band of 72 MHz, is FSK modulated. The margin of this modulation is +1.5 KHz or −1.5 KHz, and packet transmission of the signals from control section 3 is performed, by a control signal transmission timer shown in the time chart of FIG. 7.

Figure 6:
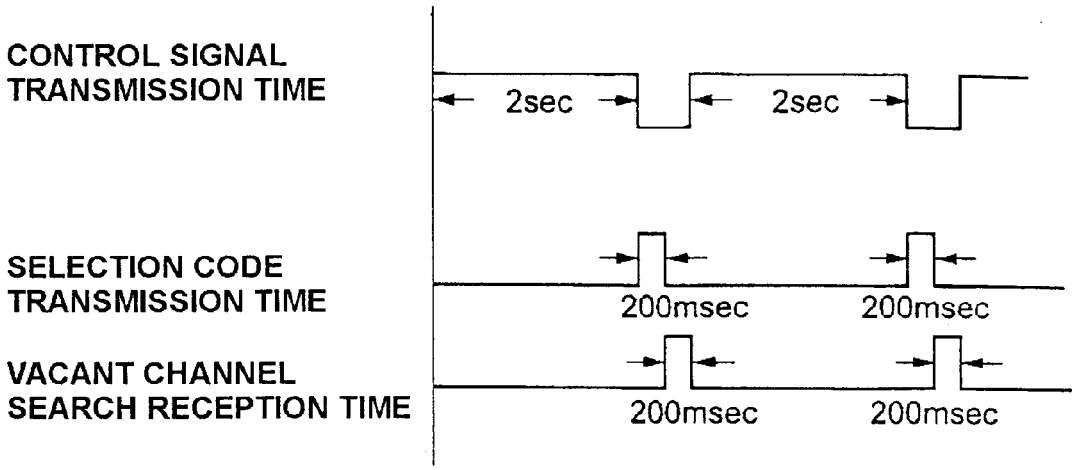
FIG. 6 is a time chart showing a time series of a selection code transmission timer.

In addition to the control signal transmission timer, a selection code transmission timer is executed by the control section 3. Referring to the time chart shown in FIG. 6, the selection code transmission timer sequentially divides time into transmission time for control signals, transmission time for a selection code, and reception time for a vacant channel search. With one frame being set to 22.5 msec, the control signals are continuously transmitted for 2 sec. The selection code is provisionally set to CTCSS. Since there are nine types of selection codes in the range of frequencies from 67.0 Hz to 250.3 Hz, the frequency band of 156.7 Hz is selected from the nine types of selection codes and utilized when transmitting the selection code. After the selection code is transmitted for 200 msec, the reception time for the vacant channel search is set to 200 msec. The transmission of the control signals, the transmission of the selection code, and the reception of the vacant channel search are thereafter repeated by the selection code transmission timer.

In particular, the present invention provides a tone squelch capability—utilizing CTCSS or DCS as the selection code—to prevent signals from another radio controlling transmission apparatus from controlling the controlled apparatus. The selection code transmission timer transmits a selection code stored in memory 3*b*, and makes the selection code signal intrude into the control signals transmitted from the radio controlling transmission apparatus to the controlled apparatus.

Following the end of the transmission of the selection code, the reception time for searching a vacant channel is set. The transmission stops and reception for searching a vacant channel by the reception section 4 begins. If a signal is received by the reception section 4 in a channel being searched, the channel is changed to the next channel in the search order, and an operation time for the next reception time is prepared. If no signal is received in a channel being searched and the channel is determined to be vacant, it is determined whether the same vacant channel data is present at an address where vacant channels are stored in memory 3*b*. If the same vacant channel data is present at the address, the stored vacant channel data is retained at the address. If no channel data is present at the address or other channel data is present at the address, the newly obtained vacant channel data is written to the address, and the vacant channel data is automatically transmitted at the next reception time.

When the controlled apparatus, for example, a model airplane, expresses an uncontrollable state during operation, the operator activates a channel change switch 6 to change the channel in the transmission section 1 to the vacant channel stored in memory 3*b* and to transmit the selection code using this channel. The operation of this channel change switch 6 is performed as an emergency measure and takes precedence over all control, including the control signal transmission timer.

Figure 5:
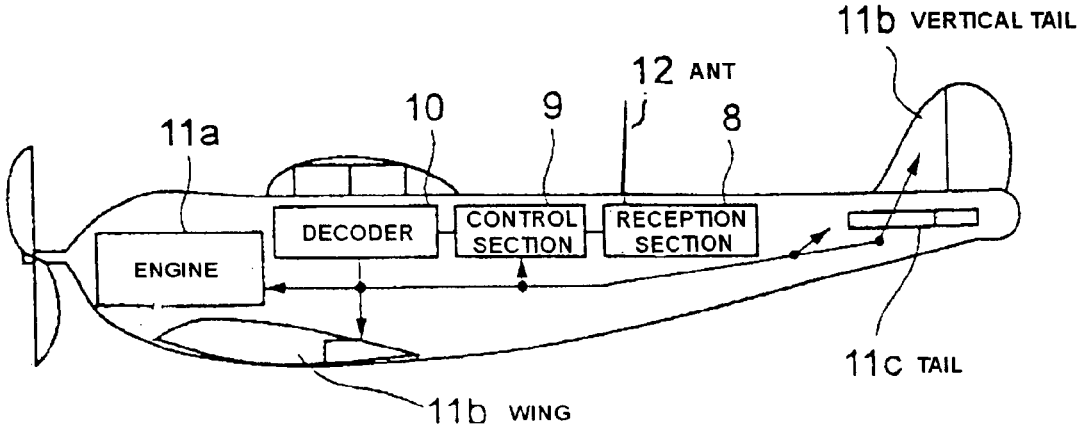
FIG. 5 is a configuration view for explaining a case in which a controlled apparatus is a model airplane.

FIG. 5 is a block diagram of a controlled apparatus according to an embodiment of the present invention. In particular, FIG. 5 shows the controlled apparatus in the form of a model airplane. The controlled apparatus comprises a reception section 8, a control section 9 having a CPU 9*a* and memory 9*b*, a decoder 10, a controlled section 11 having controlled portions including an engine 11*a*, a wing 11*b*, a tail 11*c*, a vertical tail 11*d* and an antenna 12.

When a signal is received by the reception section 8 from the antenna 12, the presence or absence of a selection code that is consistent with a selection code pre-stored in the memory 9*b* is detected. If such a selection code is not present, a squelch circuit (not shown) of the reception section 8 is closed and no control signal is outputted until the selection code is detected. In one embodiment, CTCSS, which is a tone signal of 156.7 Hz, is used as the selection code stored in memory 9*b*. If the selection code in the signal received is consistent with the selection code stored in memory 9*b*, then a selection code holding timer is set such that an ON signal for a squelch circuit is set to decoder 10. The ON signal opens the squelch circuit of the reception section 8, so that the control signals are outputted.

The control signals outputted from the reception section 8 are subjected to a serial-parallel conversion in which the control signals are converted into analog voltage signals by the control section 9. The voltage signals are sent to a decoder 10, which distributes them to the controlled portions of the controlled section 11. As a result, the engine 11*a*, wing 11*b*, tail 11*c* and vertical tail 11*d* are controlled. During the transmission of the control signals, a continuous output state of control signals is maintained by the ON signal for opening a squelch circuit set to decoder 10. If a set vacant channel data transmitted from the radio controlling transmission apparatus is received and detected, the reception section 8 clears the channel address for storing vacant channels in memory 9*b* and rewrites the set vacant channel data to the channel address. On the other hand, if a set vacant channel data is not detected by the reception section 8, the channel data stored in the channel address is retained. At this point, the vacant channel data stored in the memory 3*b* at the radio controlling transmission apparatus should be the same as the vacant channel data stored in the memory 9*b* at the controlled apparatus.

If the selection code is detected from the signal received by the reception section 8 during the duration of selection code holding timer, the selection code holding timer restarts to continue the squelch opening state and control signals are sequentially inputted and the controlled state is continuously maintained.

If the duration of selection code holding timer has passed and no selection code is detected, the control section 9 stops the ON signal for opening a squelch circuit and outputs a signal expressing control abnormality. For example, if the control signals from the radio controlling transmission apparatus dictate the model airplane shown in FIG. 5 to circle by turning right, the signal expressing control abnormality would reverse the control signals and make the model airplane turn left. In one embodiment, any one of the control signals, which are present just before the occurrence of control abnormality, are either reversed or have its control value changed by a fixed amount. This makes it possible for an operator to confirm control abnormality. After control abnormality is performed, the channel for the reception section 8 to receive signals from the radio controlling transmission apparatus is changed to the vacant channel stored in the memory 9*b*. Finally, the controlled apparatus waits for the reception of the selection code using this channel.

If the channel change switch 6 is activated when control abnormality of the controlled apparatus is visibly confirmed by the operator, then the transmission channel in the transmission section 1 of the radio controlling transmission apparatus is changed to the vacant channel stored in the memory 3*b*. The selection code is then transmitted using this channel. This transmission at 200 msec, similar to the transmission time of a selection code, allows the controlled apparatus to confirm the reception of the selection code. The channel in the reception section 4 in the radio controlling transmission apparatus is changed to the next vacant channel to be searched. Thus, the radio controlling apparatus is returned to a normal control state.

Figure 2:
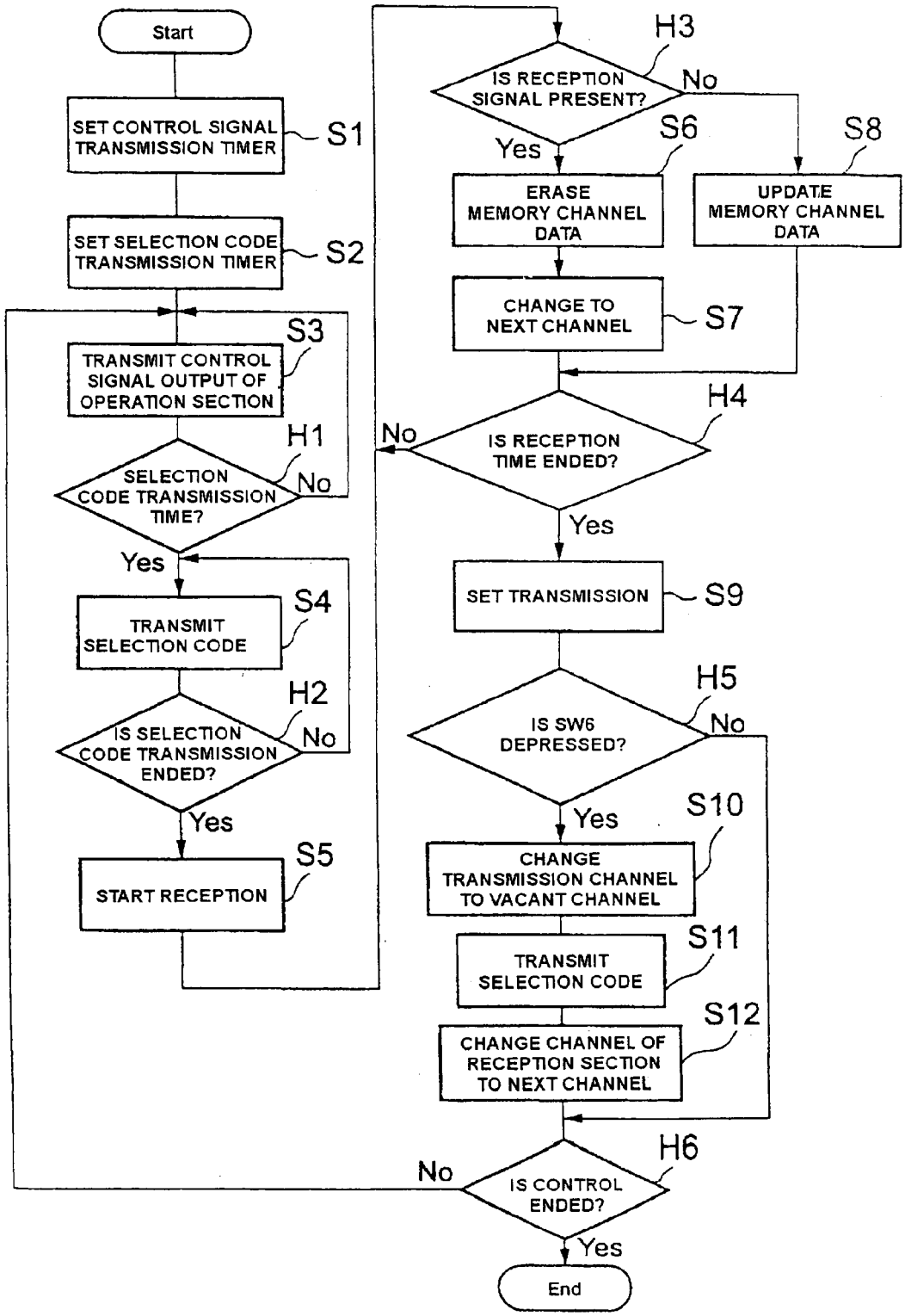
FIG. 2 is a flowchart showing an operation of the radio controlling transmission apparatus according to an embodiment of the present invention.

FIG. 2 is a flowchart showing an operation of the radio controlling transmission apparatus according to an embodiment of the present invention. In step S1, a control signal transmission timer is set. Then, in step S2, a selection code transmission timer is set. Next, control signals, generated by the operation of an operation section 2, are transmitted from a transmission section 1 in step S3.

After the control signals are transmitted, it is determined whether or not a transmission time for a selection code has been set in step H1. If it has not been set, step S3 is executed again. When it has been set, the selection code stored in the memory 3*b* is read and transmitted in step S4. The selection code is transmitted until the end of the transmission time for the selection code is confirmed in step H2. When it is determined that the transmission time for the selection code has ended in step H2, the operation proceeds to step S5.

In one embodiment, a reception section 4 is in a vacant channel search reception mode in step S5. Then, the presence or absence of a received signal for a channel being searched is determined in step H3, wherein the presence of a received signal would indicate that the channel being searched is in-use by other devices. If the received signal is present, vacant channel data for indicating that the channel being searched is vacant is erased from the memory in step S6. Next, the channel of reception section 4 is changed to the next channel in the search order in step S7, and the operation proceeds to step H4. If the received signal is absent, vacant channel data stored in the memory 3*b*, indicating that the channel being searched is vacant, is retained or updated in step S8. The reception is executed until the end of the reception time is confirmed in step H4.

When the reception time is determined to have ended, the operation changes to transmission in step S9 and the vacant channel data is transmitted as a set vacant channel data to the controlled apparatus. Next, in step H5, it is determine whether or not a channel change switch 6 has been depressed, indicating control abnormality. If the channel change switch 6 has not been depressed, the operation jumps to step H6. If the channel change switch 6 has been depressed, the transmission channel is changed to the vacant channel indicated by the vacant channel data stored in the memory 3*b* in step S10. Then, the selection code is transmitted in step S11, and the channel of reception section 4 is set to the next channel in the search order in step S12. Finally, it is determined whether or not the control has ended in step H6. If the control has not ended, the operation returns to step S3. If the control has ended, all control is stopped.

Figure 3:
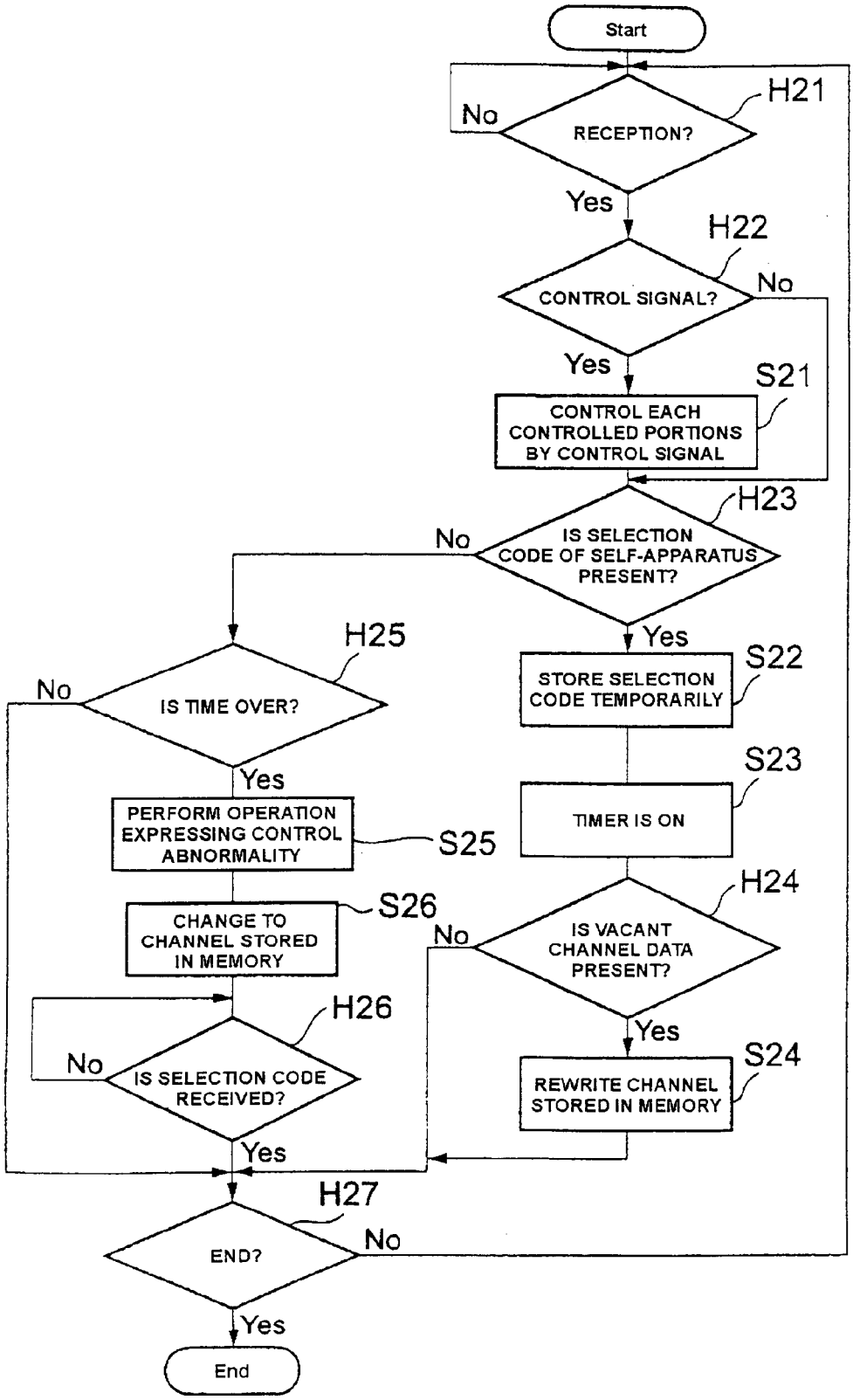
FIG. 3 is a flowchart showing an operation of the controlled apparatus according to an embodiment of the present invention.

Next, the operation of the controlled apparatus will be explained with reference to FIG. 3. In step 21, it is determined whether or not a reception section 8 of the controlled apparatus is in the reception mode to receive a signal from the radio controlling transmission apparatus. If the reception section 8 is in the reception mode, the presence or absence of control signals in the signal received is determined in step 22, wherein control signals different from the selection code by less than 250 Hz is detected. If control signals are present, the controlled portions of the controlled section 11 are controlled by the control signals in step S21. The operation then proceeds to step H23. If the control signals are not present, the operation skips step S21 and jumps to step H23. In step H23, the presence or absence of the selection code, which associates the controlled apparatus with the radio controlling transmission apparatus, is determined.

If the selection code is present in the signal received, the selection code is temporarily stored in step S22. Then, a selection code holding timer is started in step S23. Next, in step H24, it is determined whether or not a set vacant channel data transmitted by the radio controlling transmission apparatus is present in the signal received. If the set vacant channel data is present, the channel address storing vacant channels in memory 9*b* is rewritten to contain the set vacant channel data, and the operation proceeds to step H27. On the other hand, if the set vacant channel data is not present, the operation jumps directly to H27 without the channel address in memory 9*b* being updated.

If the selection code is found not to be present in step H23, it is determined whether or not a set selection code holding timer is over in step H25. If it is not over, the operation jumps to step H27. If it is over and the selection code is not present, an operation expressing control abnormality is performed in step S25. For example, a signal obtained by reversing one of the control signals is output to the control portions of the controlled section 11, so that abnormal operation is expressly performed. Next, in step S26, the vacant channel indicated by the vacant channel data stored in the memory 9*b* is set to be the new reception channel for receiving the signal from the radio controlling transmission apparatus. Then, in step H26, the receiving state is maintained until the selection code is received by the controlled apparatus through the new reception channel. If the selection code is received, it is determined whether or not the reception of the signal from the radio controlling transmission apparatus has ended in step H27. If the reception has not ended, the operation returns to step H21, and all capabilities are stopped until the reception has ended.

According to an embodiment of the radio controlling apparatus of the present invention, a reception section for detecting a vacant channel is provided in a radio controlling transmission apparatus when an uncontrollable state occurs by radio interference during the operation. Each transmission and reception are sequentially executed by a selection code transmission timer, which switches transmission time for control signals, transmission time for selection code, and reception time for searching a vacant channel in time series. When it is determined that control abnormality occurs in a controlled apparatus due to radio interference, a transmission channel in the radio controlling transmission apparatus is changed to a vacant channel and the selection code is transmitted using the vacant channel. This allows the radio controlling transmission apparatus to regain control of the controlled apparatus.

In the embodiment, the vacant channel data, which has been transmitted during the time series of the selection code transmission timer by the radio controlling transmission apparatus, is stored in memory of the controlled apparatus. Further, the selection code, which is intermittently inputted into the controlled apparatus, is retained for a predetermined period of time to exert a squelch capability. When the predetermined period of time passes and no selection code is received, it is determined that an uncontrollable state has occurred. Finally, the reception channel in the reception section of the controlled apparatus is changed. The reception channel is set to the vacant channel indicated by the vacant channel data stored in the memory while an operation expressing abnormality of the controlled apparatus is performed in order to expedite radio controlling transmission apparatus's change to the vacant channel. This makes it possible to eliminate an uncontrollable state or radio interference rapidly.

While the description above refers to particular embodiments of the present invention, it will be understood that many modifications may be made without departing from the spirit thereof. The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A radio controlling apparatus comprising:

an operation section including a joy stick;

a control section having a CPU and memory;

a radio controlling transmission apparatus having a transmission section for transmitting control signals based on an operation of the operation section; and a controlled vehicle controlled by receiving the transmitted control signals and converting the received signals to parallel signals that control controlled portions, wherein when an uncontrollable state of a transmission channel occurs in the radio controlling transmission apparatus due to radio interference, the radio controlling apparatus utilizes a reception section to automatically search a plurality of alternate channels for a vacant channel, and automatically changes the transmission channel to the vacant channel.

2. The radio controlled apparatus according to claim 1, wherein the radio controlling transmission apparatus comprises means for setting a selection code transmission timer for assigning a control signal transmission time, a selection code transmission time and a reception time, so as to transmit a selection code that distinguishes the control signals of the controlled vehicle from control signals of another apparatus at the selection code transmission time.

3. The radio controlling apparatus according to claim 1, wherein the controlled apparatus comprises detecting means for detecting a selection code from received signals;

squelch means for setting a selection code holding timer, which determines a detection interval of the selection code, and for holding a squelch state so as to output control signals for the duration of the selection code holding timer in which the selection code is held.

4. The radio controlling apparatus according to claim 1, wherein the controlled vehicle comprises detecting means for detecting a selection code from received signals;

storing means for storing the detected selection code; and squelch means for setting a selection code holding timer, which determines a detection interval of the selection code, and for holding a squelch state so as to output signals for the duration of the selection code holding timer in which the selection code is held.

5. The radio controlling apparatus according to claim 4, wherein the controlled vehicle comprises vacant channel holding means for storing or rewriting channel data of the memory storing vacant channels when there is a vacant channel data in the received signals.

6. The radio controlling apparatus according to claim 5, wherein when the selection code holding time is over during the reception of the control signals and a squelch capability stops, the reception channel is automatically changed to a vacant channel stored in the channel data of the memory and an abnormal operation by which control abnormality is visibly recognized is executed, and if there is the selection code in the signals received by the reception section, a squelch capability is exerted so that a controlled state is set.

7. The radio controlling apparatus according to claim 1, wherein when the radio controlling transmission apparatus detects control abnormality of the controlled vehicle during the control of the controlled vehicle performed by the operation of the control section, a channel change switch is operated to perform a change to a vacant channel stored in the memory, and the identification code is transmitted to restart control of the controlled vehicle.

8. The radio controlling apparatus according to claim 2, wherein CTCSS or DCS is used as the selection code to control the controlled section by a squelch signal, thereby preventing radio interference.

9. The radio con controlling apparatus according to claim 5, wherein CTCSS or DCS is used as the selection code to control the controlled section by a squelch signal, thereby preventing radio interference.

10. The radio con controlling apparatus according to claim 6, wherein CTCSS or DCS is used as the selection code to control the controlled section by a squelch signal, thereby preventing radio interference.

11. The radio con controlling apparatus according to claim 7, wherein CTCSS or DCS is used as the selection code to control the controlled section by a squelch signal, thereby preventing radio interference.

12. A communications device for a radio controlled model comprising a hand-held transmitter operated by a user and adapted to communicate with a receiver on the model, the hand-held transmitter comprising:

a manually operated input device for inputting commands to be relayed to the model;

circuitry for converting the commands into digital command signals;

a clock for establishing a repeating transmission period;

digital command transmitting means for transmitting the digital command signals to the receiver on the model during a first scheduled portion of the repeating transmission period;

channel scanning means for scanning a predetermined frequency range to select a vacant alternate channel for transmitting signals to the receiver;

memory for storing a vacant alternate channel;

alternate channel transmitting means for communicating the vacant alternate channel to the receiver during a second scheduled portion of the repeating transmission period; and channel switching command transmitting means for transmitting to the receiver a command to switch communications to the vacant alternate channel.

13. The communications device of claim 12 further comprising interference detection circuitry for detecting an interfering communications signal, and for actuating the channel switching command transmission means upon said detection to transmit to the receiver the command to switch communications to the vacant alternate channel.

14. The communications device of claim 12 further comprising manual input means for overriding the scheduled portion of the repeating transmission period and communicating the channel switching command transmission means to transmit to the receiver the command to switch communications to the vacant alternate channel.

15. The communications device of claim 12 further comprising means for determining if the stored vacant alternate channel is not currently vacant, and for communicating a new vacant alternate channel to the receiver during the second scheduled portion of the repeating transmission period.

16. A radio controlled system for a model comprising:

a hand held transmitter comprising:

a manually operated input device for inputting control commands to be relayed to the model;

circuitry for converting the control commands to digital control signals;

a microprocessor including a clock for establishing a repeating transmission period;

a channel scanner for scanning available channels for vacancy;

memory for storing a frequency of a vacant available channel;

a signal generator that generates a vacant channel switching signal indicating to the model that a new vacant channel frequency is to be transmitted; and a transmitter for transmitting during a first portion of the repeating transmission period said digital control signals, and for transmitting during a second portion of the repeating transmission period said vacant channel switching signal, and for transmitting during a third portion of the repeating transmission period the frequency of the vacant channel; and a model including circuitry comprising:

a receiver for receiving said digital control signals, said vacant channel switching signal, and said frequency of the vacant channel;

a squelching control for squelching the control of the model during reception of the vacant channel switching signal and the frequency of the vacant channel; and channel switching means for switching from a current channel to the vacant channel upon instruction in the vacant channel switching signal.

17. The communications system of claim 16 further comprising interrupt signal generating means for interrupting the repeating transmission period and initiating immediate switching between the hand-held controller and the model to the vacant channel.

* * * * *